US007335845B2

(12) United States Patent
Johnsen et al.

(10) Patent No.: US 7,335,845 B2
(45) Date of Patent: Feb. 26, 2008

(54) AIR-GAP SWITCH

(75) Inventors: Roger T. Johnsen, Salt Lake City, UT (US); Richard C. Hedderich, Sandy, UT (US); James K. Russell, Sandy, UT (US)

(73) Assignee: Control4 Corporation, Draper, UT (US)

( * ) Notice: Subject to any disclaimer, the term of this patent is extended or adjusted under 35 U.S.C. 154(b) by 257 days.

(21) Appl. No.: 11/064,988

(22) Filed: Feb. 23, 2005

(65) Prior Publication Data

US 2005/0184677 A1 Aug. 25, 2005

Related U.S. Application Data

(60) Provisional application No. 60/547,669, filed on Feb. 24, 2004.

(51) Int. Cl.
*H01H 15/00* (2006.01)
*H01H 3/20* (2006.01)

(52) U.S. Cl. ..... 200/332

(58) Field of Classification Search ..... 200/332
See application file for complete search history.

(56) References Cited

U.S. PATENT DOCUMENTS

| | | | | |
|---|---|---|---|---|
| 4,783,581 | A * | 11/1988 | Flowers et al. | 200/542 |
| 6,727,446 | B1 * | 4/2004 | Mayo et al. | 200/296 |
| 6,734,381 | B2 * | 5/2004 | Mayo et al. | 200/329 |
| 7,009,122 | B2 * | 3/2006 | Pearson et al. | 200/38 R |
| 2005/0280598 | A1 * | 12/2005 | Webb et al. | 343/867 |

* cited by examiner

*Primary Examiner*—Elvin Enad
*Assistant Examiner*—Lheiren Mae A. Anglo
(74) *Attorney, Agent, or Firm*—Thorpe North & Western LLP

(57) ABSTRACT

A switching device is provided having an air-gap switch for an electrical load. The switching device can include a switch keycap configured for controlling the switching of the electrical load. A faceplate can be configured to surround the switch keycap. In addition, an air-gap actuator can be contained substantially within the switch keycap. The air-gap actuator can be pulled from the switch keycap to short out an electrical connection to the electrical load.

18 Claims, 3 Drawing Sheets

AIR-GAP SWITCH

This application claims the benefit of U.S. application No. 60/547,669 filed Feb. 24, 2004.

BACKGROUND

Lighting dimmers mounted in wall boxes often require, by building safety code, the ability to completely disconnect the power that is provided to the lighting load (or other type of dimmable load) when servicing the load. For example, servicing the load can be changing a burned-out light bulb or florescent tube. Standard mechanical light switches accomplish this by definition, because such switches mechanically open the electrical circuit and prevent current from flowing.

Electronic dimmers operate by essentially restricting the average current flow through the load by means of controlling the conduction of the load current using a solid-state device such a triac. The longer the triac is allowed to conduct in each AC cycle, the more average current is provided to the load. The "OFF" state is when the triac is not allowed to conduct at all. Even though a light bulb will appear to be completely off in this state, there is measurable leakage current through the triac that governmental and/or other safety agencies deem to be potentially dangerous. Therefore, dimmers may be required to have a mechanical switching means to open the circuit for purposes of servicing the load, and this is referred to as an "air-gap switch". Various means have been previously devised to provide dimmers with the required air-gap functionality.

One known air-gap mechanism uses a plastic pull-down switch that protrudes downwardly from the bottom of the switch faceplate. This pull-down switch is oriented parallel with and against the wall. In the normal "ON" position, the clear plastic air-gap actuator is barely visible below the faceplate. The air-gap switch is activated to turn the load off by pulling down on the actuator. The shaft operates a linearly-actuated mechanical air-gap switch. Some disadvantages of this general design are: 1) the actuator is visible and unattractive because it protrudes from the bottom of the faceplate, and 2) it may require notching out the back of faceplates that a homeowner or decorator may wish to attach to the dimmer in order to accommodate the shaft of the air-gap switch actuator. In the instance of a metal plate, it may not even be possible to modify a particular faceplate to work with this type of air-gap switch.

With the foregoing limitations in mind, other dimmer manufacturers have chosen to incorporate the air-gap switching function within the rectangular switch plate opening, which solves the problem of interference with the faceplate. They either incorporate the switch within a narrow frame that surrounds the switch keycap, or they make the keycap smaller than the switch opening to accommodate an additional switch for the air-gap function. One disadvantage of these designs is the air-gap switch is visible and interferes with the aesthetics of the design, at best, or is downright ugly, at worst.

Other manufacturers have tried to solve the aesthetics problem by including a processor-controlled relay within the dimmer that automatically provides the air-gap function. The processor can open the load circuit with a relay every time the dimmer is either switched off or dimmed until the minimum level is reached (which is by definition off). This switch configuration has no need for any type of externally actuated air-gap switch since its air-gap function is actuated by the switch keycap itself using the relay.

This processor and relay method works fine if the microcontroller in the dimmer is always active, which means the dimmer is always receiving AC power. The dimmer always receives power in cases when a neutral or ground wire is available in the wall box in which the dimmer is installed. However, it is common to have wiring situations where a neutral wire is not available in the wall box. In these situations, the dimmer is not powered in parallel with the hot and neutral AC wires, but in series with the hot and load wires. For series connections, a special type of power supply is needed to power the dimmer. In essence, the "load-line-powered" dimmer's power supply steals some of the current from the hot lead to power its own circuitry, while its power supply return path is actually through the load.

Of course, if this load-line-powered dimmer's power supply return path is opened for any reason, then the dimmer is shut off just as though a power switch shut off the dimmer's circuitry. Once the dimmer's microcontroller is shut off, it has no way to close the relay again. Yet, if the relay is not ever closed again, the microcontroller will never receive power to allow itself to operate. This places the microcontroller in the situation of needing power to close the switch but not having power to operate itself. This is why a relay-air-gap-style dimmer was designed to only be installed in situations where a neutral is available. A load-line-powered, relay-air-gap version of such a dimmer is not provided, because the circuit topology simply cannot be used in a series-connected configuration.

SUMMARY

Figure 1A:
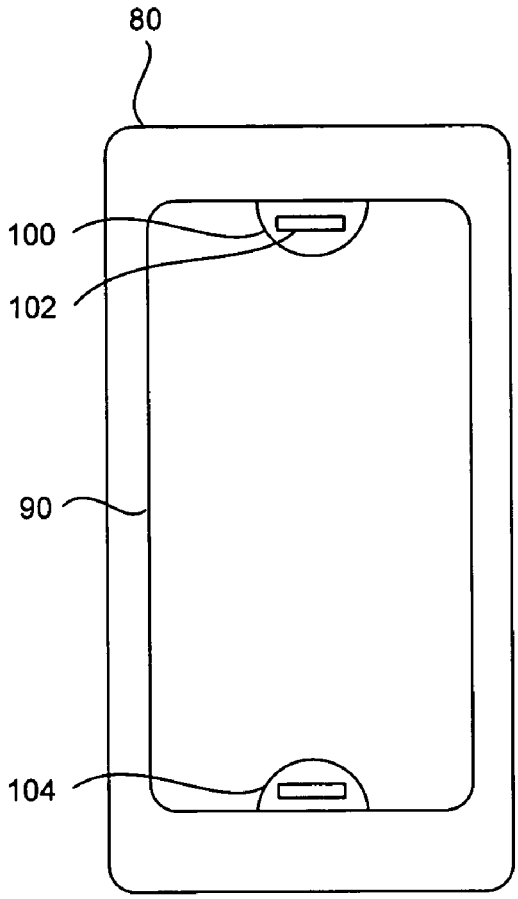
FIG. 1*a* is front view of an air-gap switch and lightpipe assembly in an "ON" position for a switch keycap in accordance with an embodiment of the present invention.

A switching device is provided having an air-gap switch for an electrical load. The switching device can include a switch keycap configured for controlling the switching of the electrical load. A faceplate can be configured to surround the switch keycap. In addition, an air-gap actuator can be contained substantially within the switch keycap. The air-gap actuator can be pulled from the switch keycap to open an electrical connection to the electrical load.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The system and method of the present invention includes a superior air-gap system that is incorporated within the opening of a faceplate for a switch. The air-gap system can be configured to blend with the aesthetics of the switch keycap by integrating with the keycap function. The faceplate can be made of plastic, metal, or other construction materials used in electrical switch devices.

The actuator of the present invention may serve a dual function. One functional element is the air-gap actuator used to open the circuit and the other functional element is a lightpipe system used to indicate the status of the air-gap switch and/or dimmer. In one embodiment, the switch keycap has at least one LED lightpipe indicator on the top and bottom edges of the keycap for indicating statuses and events. One of the lightpipes can be the air-gap actuator lightpipe.

FIG. 1*a* illustrates a switch keycap 90 with the air-gap switch 104 or actuator in the normal (ON) position. A lightpipe 100 and lightpipe emitter area 102 can be located at the top of the switch keycap. The air-gap switch 104 can also include a lightpipe emitter area. A switch keycap frame or faceplate 80 may surround the switch keycap.

Figure 1B:
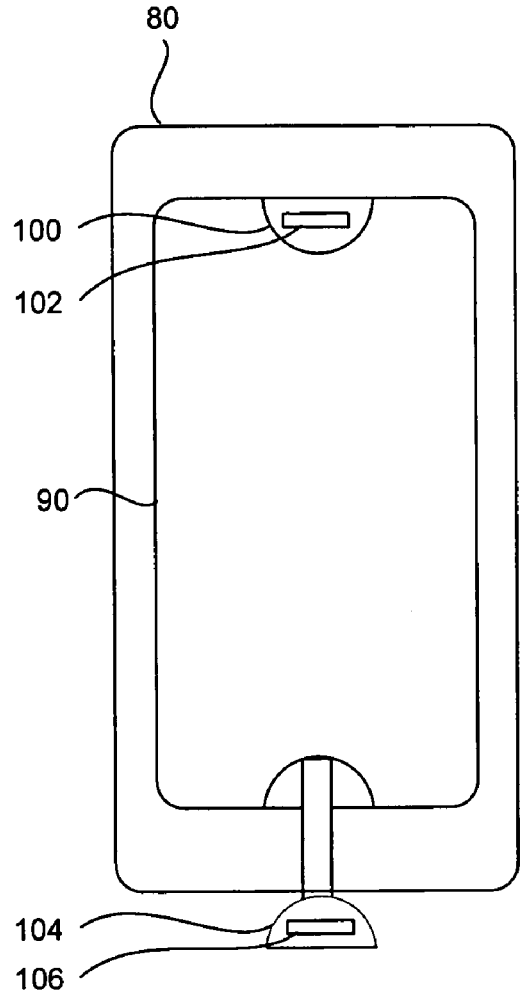
FIG. 1*b* is front view of an air-gap switch and lightpipe assembly in an "OFF" position for a switch keycap in accordance with an embodiment of the present invention.

FIG. 1*b* illustrates the air-gap switch 104 in the actuated (OFF) position and a rectangular lightpipe emitter 106 is also shown. The air-gap switch can be spring loaded to provide a minimal amount of travel or the switch may be operated without spring loaded assistance. Other types of switch activations that are known to those skilled in the art may be used to support an air-gap switch mounted substantially within the switch keycap.

Figure 2:
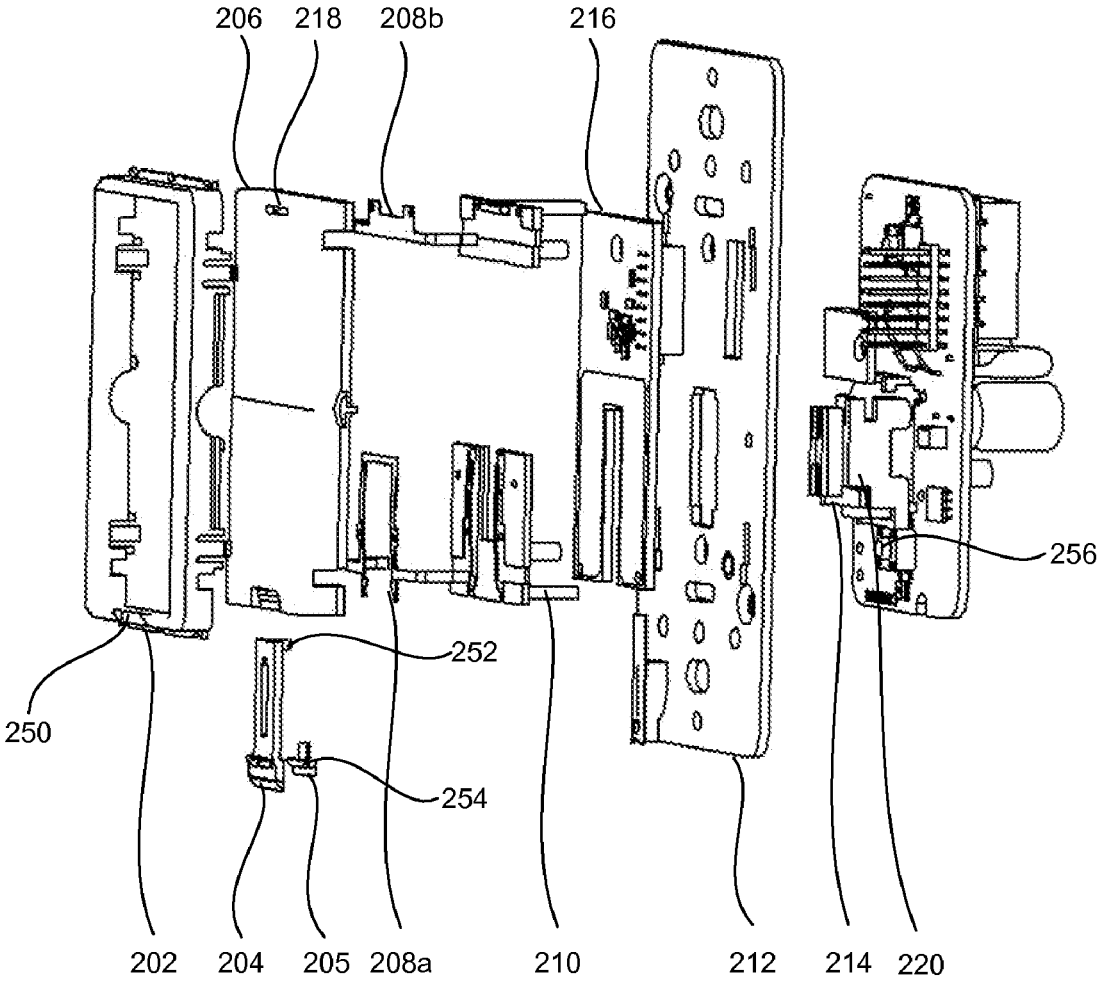
FIG. 2 is an exploded perspective view of an embodiment of an air-gap switch and lightpipe assembly for a switch keycap.

FIG. 2 is an exploded perspective view of an embodiment of an air-gap switch and lightpipe assembly for a switch keycap. The switching device can be used for switching an electrical load such as an incandescent light, fluorescent light, electrical plug, appliance, or another electrical load.

A switch keycap 206 can be configured for controlling the switching of the electrical load. The switch keycap may activate toggle switches or pole switches for controlling the electrical load. In addition, the switch keycap can act as a dimmer when the dimmer mode has been activated or a separate control may be provided for dimming. A faceplate (not shown) can be configured to surround the switch keycap and cover the switching circuitry and junction box.

An air-gap actuator 204 may be contained substantially within the switch keycap frame 206. The air-gap actuator can be pulled from the switch keycap in order to short out an electrical connection to the electrical load. This allows the user of the switch and electrical load to safely service the electrical load. For example, a light may need to be changed and the air-gap switch allows that to happen safely.

The air-gap actuator can be mounted in a track or cam guide formed into or attached to the switch keycap 206. In addition, the air-gap actuator is designed to be pulled out from the switch keycap in a plane that is substantially coincident or parallel to the switch keycap surface. In other words, the air-gap actuator can be pulled out from an edge of the keycap.

A ridge 254 on the air-gap switch can be provided to enable an end user to pull the air-gap actuator out from the switch keycap. The ridge on the air-gap actuator may be the depth of a person's fingernail or there may be multiple ridges to provide additional "finger traction". A maximum extension stop 252 can be provided for the air-gap actuator to limit the travel of the air-gap actuator. The maximum extension stop can be provided as part of the switch keycap or part of an actuator cam.

A switch keycap frame 202 can be provided that surrounds the switch keycap 206. The switch keycap frame may contain a slot 250 configured to allow the air-gap actuator to pass over the switch keycap frame. Alternatively, the switch keycap frame may be thin enough (or short enough) to allow the air-gap switch to pass over the frame unimpeded. In one embodiment, the switch keycap frame can be beveled as shown in FIG. 2.

A first portion of the air-gap switch may be contained within a border of the switch keycap and a second smaller portion of the air-gap switch may be configured to overlap the switch keycap frame. Alternatively, the entire air-gap switch can be contained within the border of the switch keycap when the air-gap switch is in the "OFF" position.

A snap-action switch 220 can be provided to make and break an electrical connection for the electrical load. An actuator cam 214 can be arranged in mechanical communication with the air-gap actuator, and the actuator cam may be configured to actuate the snap-action switch. The actuator can be contained under the cam guides.

A radio frequency (RF) antenna and related RF transmission circuitry 216 can be contained on a printed circuit board that can be affixed to a yoke plate 212 or aluminum heat sync. The distance between the RF antenna and the yoke plate can be engineered to improve RF transmission and reception.

A lightpipe conduit 210 can be included with the air-gap actuator system. The lightpipe conduit(s) can guide light from an LED 256 on a circuit board to a lightpipe emitter 205 that reaches the surface of the air-gap actuator. In particular, the lightpipe emitter can just be in optical communication with the lightpipe conduit or the two elements may be fused together into a single light guide.

Electrostatic discharge (ESD) shunts 208*a*, 208*b* may optionally be included in the switch keycap. The shunts allow any static electrical charges from a user of the switch to be harmlessly discharged away from the electrical circuitry contained within the switch. For example, static charges can be guided to a ground or common. Since static discharges can be intelligently shunted away from the circuitry, this avoids resetting the electronic circuits used to control the switch.

As illustrated in FIG. 2, the top lightpipe 218 may be fixed and conduct light perpendicularly from an LED 256 mounted on the surface of a printed circuit board (PCB) that is roughly parallel to the face of the switch keycap. The light is conducted, diffused, and emanates from the emitter surface of the lightpipe 218. Both lightpipe emitters can be rectangular, as illustrated, or another emitter shape can be used. For example, the emitter shape can be half-circle-shaped or the emitter may be another decorative shape. Moreover, the emitter can be the entire air-gap switch instead of a separate emitter embedded in the air-gap switch.

Figure 3:
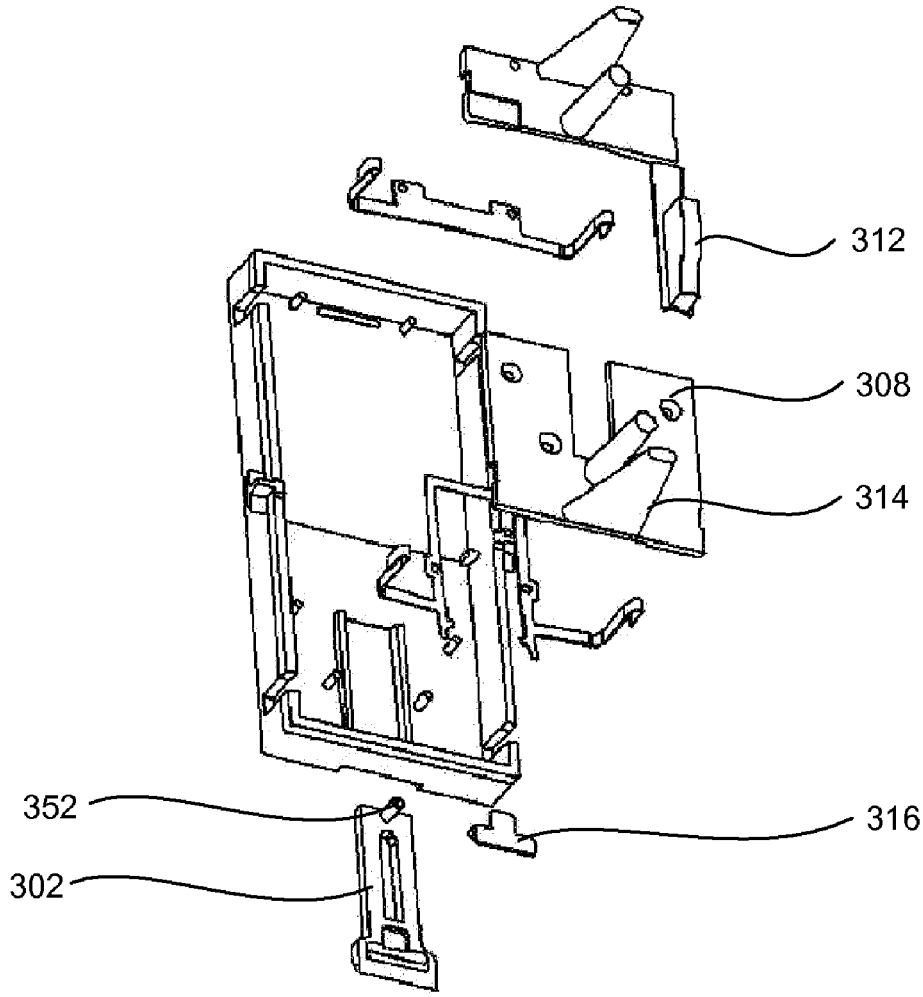
FIG. 3 is an exploded rear view of an embodiment of air-gap switch and lightpipe assembly.

FIG. 3 is an exploded rear view of an embodiment of an air-gap switch and lightpipe assembly. The air-gap switch and lightpipe system may contain at least two pieces. First, the air-gap switch includes a fixed lightpipe conduit 314 and lightpipe base 308 that conduct light upwardly from the surface-mounted LED (not shown). The air-gap actuator 302 and lightpipe emitter 316 can be placed in close proximity to the end of the fixed lightpipe conduit such that the lightpipe emitter accepts light from the lightpipe conduit and conducts the light upwardly to emanate from the lightpipe emitter surface.

Creating the air-gap by sliding down the air-gap actuator 302 can completely disconnect power from the load. The bottom or top lightpipe emitter surface can be half-circle-shaped, square, round, triangular, hex, s-shaped, or another decorative shape. The lightpipe conduit and emitter can be made of a clear plastic to transmit a white light or a colored plastic to emit a colored output. Alternatively, multiple colored LEDs can be used to change the color of the light output.

The air-gap switch may also be oriented in the up position or the down position. The orientation of the air-gap switch may be left to the discretion of the switch installer or end user. The air-gap switch can work equally well regardless of the up or down orientation.

The actual electro-mechanical switch used in making and breaking the electrical connections can be accomplished in a variety of ways that can be devised by one skilled in the art. One embodiment uses a snap-action switch (FIG. 2) to make and break the connections. The air-gap actuator 302, as in FIG. 3, connects to a plastic actuator cam 312. A ramp on the underside of a plastic actuator cam slides into position to make contact with the top of a snap-action switch's actuator button as the air-gap actuator is being pulled out to the "OFF" position. As the air-gap switch actuator is further pulled out, the ramp increasingly depresses the snap-action switch's actuator (220 FIG. 2) until the electrical contacts open. In an alternative embodiment, a linear position switch may be used to make and break the electrical connections.

A detented position and maximum extension stop 352 may provide tactile and visual feedback to let the user know the load has been safely disconnected from the power source. In addition, the word "OFF" may be visible to the end user. An escutcheon plate can surround the switch and keycap and may include a beveled area near the keycap.

In one embodiment, the air-gap switch actuator may be entirely non-transparent or solid plastic without a lightpipe. With this configuration, the air-gap switch actuator can still be combined with the switch key cover to provide an appealing appearance. Of course, an embodiment without a lightpipe would not conduct light for the user to view. Any lightpipe conduit used in the other embodiments may not be needed in this configuration.

The present invention provides the benefit of an air-gap actuator which is disguised as part of the switch keycap. Specifically, the actuator may include a lightpipe emitter, a fixed lightpipe to conduct light to the air-gap actuator/lightpipe, and an electronic-mechanical switch.

The combination of the air-gap switch and lightpipe system increases the aesthetic appearance of the air-gap switch. Another advantage of combining the air-gap switch with a lightpipe is that the lightpipe output can reflect the state of the air-gap switch or some other state of the dimmer. For example, a different LED color can be used when the switch is in a dimmer mode or a specific color can be used depending on which type of load is being controlled.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

The invention claimed is:

1. A switching device having an air-gap switch for an electrical load, comprising:

a switch keycap configured for switching of the electrical load;

a faceplate surrounding the switch keycap; and an air-gap actuator contained substantially within the switch keycap, the air-gap actuator being configured to be pulled from the switch keycap in a plane that is substantially coincident to a switch keycap surface in order to open an electrical connection to the electrical load.

2. A switching device as in claim 1, a switch keycap frame surrounding the switch keycap, wherein the switch keycap frame contains a slot configured to allow the air-gap actuator to pass over the switch keycap frame.

3. A switching device as in claim 1, further comprising:

a snap-action switch configured to make and break an electrical connection for the electrical load;

an actuator cam in communication with the air-gap actuator, the actuator cam being configured to actuate the snap-action switch.

4. A switching device as in claim 1, wherein a first portion of the air-gap switch is contained within a border of a switch keycap and a second portion of the air-gap switch is configured to overlap a switch keycap frame.

5. A switching device as in claim 1, further comprising:

a lightpipe conduit included with the air-gap actuator; and a lightpipe emitter extending to a surface of the air-gap actuator.

6. A switching device as in claim 5, further comprising an LED within the switching device, the LED being in optical communication with the lightpipe conduit.

7. A switching device as in claim 1, further comprising a ridge on the air-gap switch, the ridge being configured to enable an end user to pull the air-gap actuator out from the switch keycap.

8. A switching device as in claim 1, further comprising a maximum extension stop to limit the travel of the air-gap actuator.

9. A switching device having an air-gap switch for an electrical load, comprising:

a switch keycap configured for controlling switching of the electrical load;

a switch keycap frame surrounding the switch keycap;

a faceplate surrounding the switch keycap frame;

an air-gap actuator configured to have a majority of the air-gap actuator recessed within the switch keycap, the air-gap actuator being configured to be pulled from the switch key-cap to completely open an electrical connection to the electrical load;

a lightpipe conduit coupled to the air-gap actuator; and a lightpipe emitter on a surface of the air-gap actuator, the lightpipe emitter being coupled to the lightpipe conduit.

10. A switching device as in claim 9, further comprising an LED within the switching device, the LED being optically coupled to the lightpipe conduit.

11. A switching device as in claim 9, wherein the air-gap actuator is configured to be pulled out from the switch keycap in a plane that is substantially coincident to the switch keycap surface.

12. A switching device as in claim 9, a switch keycap frame having a slot configured to allow the air-gap actuator to pass over the switch keycap frame.

13. A switching device as in claim 9, wherein an end shape of the lightpipe emitter is selected from the group consisting of: a rectangle, half-circle, square, round, triangular, hex, s-shaped, and half-moon shaped.

14. A switching device as in claim 9, wherein the lightpipe conduit and lightpipe emitter are colored or clear plastic.

15. A switching device as in claim 9, wherein a plurality of LED colors are used to represent different states of the switching device.

16. A switching device having an air-gap switch for an electrical load, comprising:

a switch keycap configured for controlling the switching of the electrical load;

an escutcheon plate surrounding the switch keycap;

an air-gap actuator that is recessed within the switch keycap, the air-gap actuator being configured to be pulled from the switch keycap to completely open an electrical connection to the electrical load; and the air-gap actuator does not extend into the escutcheon plate when the air-gap actuator is not activated.

17. A switching device as in claim 16, wherein the escutcheon plate is recessed below the air-gap actuator in order to allow the air-gap actuator to pass over the escutcheon plate.

18. A switching device as in claim 16, further comprising a switch faceplate surrounding the escutcheon plate and a plate substrate to which the switch faceplate is coupled.

* * * * *